United States Patent [19]

Beudat et al.

[11] Patent Number: 4,633,688

[45] Date of Patent: Jan. 6, 1987

[54] LOCK DEVICE

[75] Inventors: Emile Beudat; Stig G. Tersaeus, both of Stockholm, Sweden

[73] Assignee: Emile Beudat, Stockholm, Sweden

[21] Appl. No.: 676,194

[22] PCT Filed: Mar. 27, 1984

[86] PCT No.: PCT/SE84/00109

§ 371 Date: Oct. 24, 1984

§ 102(e) Date: Oct. 24, 1984

[87] PCT Pub. No.: WO84/03909

PCT Pub. Date: Oct. 11, 1984

[30] Foreign Application Priority Data

Mar. 28, 1983 [SE] Sweden ..... 8301728

[51] Int. Cl.[4] ..... E05B 47/00

[52] U.S. Cl. ..... 70/279; 70/280; 292/142; 292/144

[58] Field of Search ..... 70/279, 143, 280, 277, 70/DIG. 42; 292/144, 142, 172, DIG. 62

[56] References Cited

U.S. PATENT DOCUMENTS

| | | | |
|---|---|---|---|
| 608,321 | 8/1898 | Carleton . | |
| 1,968,285 | 7/1934 | Egan | 292/172 |
| 3,266,278 | 8/1966 | Ennitt | 70/277 |
| 3,505,838 | 4/1970 | Taylor | 70/134 |
| 3,767,240 | 10/1973 | Belanger . | |
| 3,947,060 | 3/1976 | Zimmer et al. | 292/142 |

*Primary Examiner*—Robert L. Wolfe
*Assistant Examiner*—Lloyd A. Gall
*Attorney, Agent, or Firm*—Holman & Stern

[57] ABSTRACT

Lock device, including an electrically operable lock unit having at least one lock which by electrical influence can be moved between two different locations of extension in relation to the lock unit. The lock unit is arranged displacably within a surrounding casing, together with a manually and key operable lock mechanism. By influencing the lock mechanism, the electrically operable lock unit can be moved between two spaced positions in relation to the casing. In a first position, the lock unit is arranged adjacent to an edge portion of the casing, and in this position, the lock bolts can be moved by electrical influence to and from a position of engagement with a co-acting striking plate located adjacent to the casing. By influencing the manually operable lock mechanism, the electrically operable lock unit is moved to a second position, located at a greater distance from the co-acting strike plate in relation to the first position, and wherein in the second position the lock bolts can no longer engage with the striking plate.

7 Claims, 5 Drawing Figures

LOCK DEVICE

CROSS REFERENCE TO RELATED APPLICATION(S)

This United States application stems from PCT International Application No. PCT/SE84/00109 filed Mar. 27, 1984.

BACKGROUND OF THE INVENTION

The present invention relates to a lock device, intended to facilitate both electrical and manual operation.

When using electrically operable lock mechanisms, as used together with various types of electronic code locks, there is obviously also a need for such lock mechanisms which can be influenced manually, i.e. by means of an associated key or handle. For fire safety reasons, manual operation is a necessary requirement, which prevents use of lock mechanisms being operable electrically only.

For example, with regard to entrance door lock installations of today, a conventional manually operable lock mechanism is arranged located enclosed within the entrance door, arranged to facilitate operation by means of a key from the outside of the door, and having a manually operable handle by the inside surface of the door. When installing an electronic lock device, having an externally located key pad by means of which a certain code sequence can be programmed for operation of the lock mechanism, an electrically operable device is attached to the inside surface of the door adjacent to the handle, mechanically connected to the shaft of said handle, whereby any opening movement of the lock mechanism can be achieved when correct code sequence is programmed. This solution has a number of disadvantages, since the electrically operable device is mounted externally on the inside surface of the door, and thus easily can be made subject to outside forces, with the intention to prevent same from operating. Also from an aesthetical point of view, such an externally mounted device is not desirable. There are also certain risks that the lock handle is jammed by means of fire or other outside forces, thus preventing or slowing down an emergency exit.

SUMMARY OF THE INVENTION

An object of the present invention is to provide a lock device which meets existing requirements relating to safety in case of fire, and also provides safety against outside influences, thus completely overcoming the disadvantages related to previously utilized devices. The lock device according to the present invention is also mounted rapidly and easily, and facilitates simple and fast service, if service is required. An important feature is that the lock device is completely enclosed between the outside and inside surfaces of the door, and that it facilitates mounting within the space existing for mounting a conventional and key operated lock mechanism.

The lock mechanism according to the present invention includes an electrically operable lock unit, including one or more electrically operable lock bolts, having positions of extensions in relation to the unit which can be changed by electrical influence, and the lock unit is arranged displacably in relation to a surrounding lock casing, which lock casing also includes a conventional manually operable lock mechanism, the electrically operable lock unit being arranged to take up a first position when the manually operable lock mechanism is uninfluenced, in which an electrically operable lock bolt or bolts can respectively engage and respectively disengage, an associated striking plate, influence on the manually operable lock mechanism being arranged to displace the electrically operable lock unit into a second position within the surrounding lock casing, located at a greater distance from the striking plate, thereby moving the lock bolt(s) of the lock unit from a position of engagement with the striking plate.

BRIEF DESCRIPTION OF THE DRAWINGS

An example of an embodiment of a lock device according to the present invention is more fully described below with reference to the accompanying drawings, in which.

DETAILED DESCRIPTION OF THE INVENTION

Figure 1:
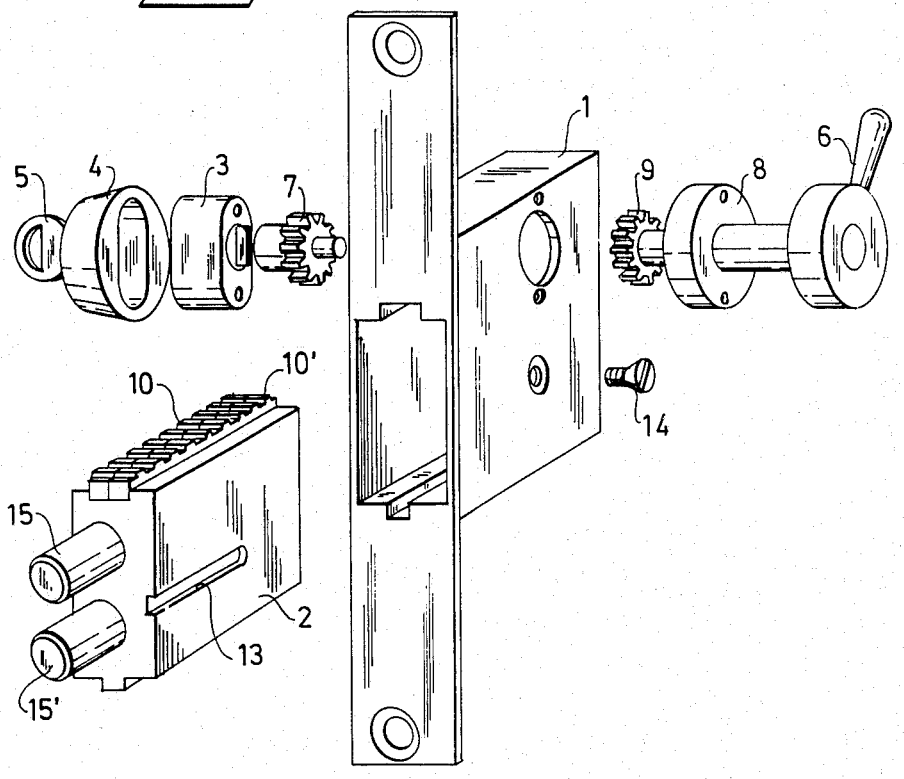
FIG. 1 is an exploded perspective view of a lock device according to the present invention, intended to illustrate an embodiment within the scope of the invention.

With reference to FIG. 1, an example of an embodiment of a lock device according to the present invention is shown with included parts located separated from each other. Said embodiment comprises an external lock casing 1, an electrically operable lock unit, which as a complete unit is denominated 2, a conventional cylinder lock mechanism 3 with related surrounding housing 4, a key 5 for influencing the lock mechanism 3, and a manually operable handle 6, intended to be located adjacent to an internal door surface.

The shown embodiment is arranged to facilitate a manual opening movement from the outside or inside surface of a door, regardless of whether or not the opposed side has been manipulated in such a way, that the handle 6, or the lock mechanism 3, has been jammed to prevent rotation.

The lock mechanism 3, operable by means of the key 5, is connected to a cog wheel 7, and an axle 8 extends from the handle 6, connected to a second cog wheel 9. Adjacent to the upper surface of the electrically operable lock unit 2, two racks 10, 10' are arranged, one rack 10 being arranged to mesh with the first cog wheel 7 and the other rack 10' being arranged to mesh with the second cog wheel. Each rack 10, 10' is arranged with an abutment means 11, extending towards the electrically operable lock unit 2, located in a groove 12 extending in longitudinal direction of said unit 2.

Figure 2:
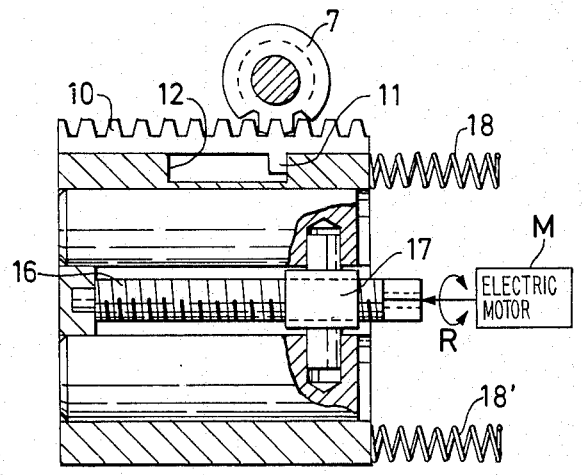
FIG. 2 is a cross-sectional view of a part of the embodiment of a lock device shown in FIG. 1.

The electrically operable lock unit 2 is also arranged at a side surface with a groove 13, open towards the front end surface, and intended to co-act with a stop means 14, in the shown embodiment arranged as a stop screw, attached to a side surface of the lock casing 1. Two electrically operable lock bolts 15, 15' are also shown, which in FIG. 1 are arranged in a position extending from the lock unit 2, and in FIG. 2 are moved back to a position enclosed within the lock unit 2. The number of lock bolts 15, 15' can obviously be varied from one only to desired number, and the shown number of lock bolts 15, 15' should thus in no way be regarded as restrictive.

FIG. 2 indicates an example of how the lock bolts 15, 15' electrically can be moved between the positions shown in FIGS. 1 and 2. An axle 16, having an external screw thread, is located in an intermediate position in relation to the lock bolts 15, 15', surrounded by a nut 17, from which two pin-shaped members extend, arranged to join the nut 17 with the lock bolts 15, 15'. The direction of movement is obviously related to the direction of rotation imposed on the axle 16 by means of the motor M.

A displacement movement can obviously also be achieved by means of other ways than utilization of an electric motor, e.g. by use of lock bolts 15, 15' which are electromagnetically influenced to perform necessary displacement movements, but other previously known methods for causing linear displacement movements by electrical influence can obviously also be used.

When the parts shown in FIG. 1 are joined together, the electrically operable lock unit 2 is arranged enclosed within the lock casing 1, the front surface of the lock unit 2 preferably being arranged to coincide with the front surface of the lock casing 1. The stop screw 14, the front portion of which extends into the groove 13, prevents the lock unit 2 from being displaced further outwardly from the lock casing 1, but facilitates a displacement movement of the complete lock unit 2 towards the internal bottom surface of the lock casing 1. Between the lock unit 2 and said internal bottom surface within the lock casing 1, return springs 18, 18' are arranged, which apply a force on the lock unit 2 directed towards the front surface of the lock casing 1.

The complete lock device is mounted in a door as a conventional and manually operable lock device, the only difference being an electrical connection to the electrically operable lock unit 2, which is connected to the member by means of which electrical influence is intended to be applied. By influencing said member, the lock bolts 15, 15' can thus be moved from a position engaging with a striking plate, and also be moved back to said engaging position. This is more closely illustrated in FIGS. 3 and 4, which figures illustrate the alternative positions of the lock bolts 15, 15' when influenced electrically, and also the position of the electrically operable lock unit 2 in relation to the surrounding lock casing 1.

Figure 3:
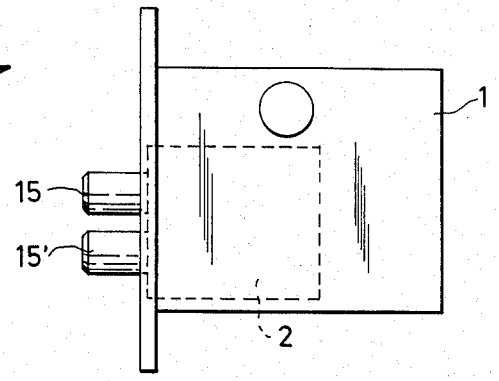
FIG. 3 is a side view of the lock device shown in FIG. 1, showing same in locked position, i.e. when the lock device is not influenced manually or electrically.
Figure 4:
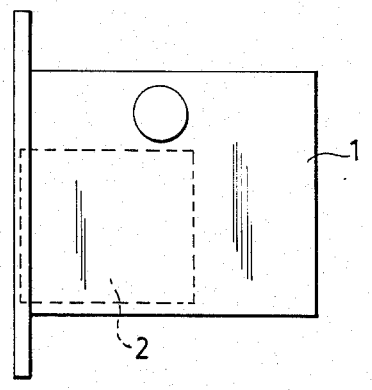
FIG. 4 is a view corresponding to FIG. 3, showing the device influenced electrically only.
Figure 5:
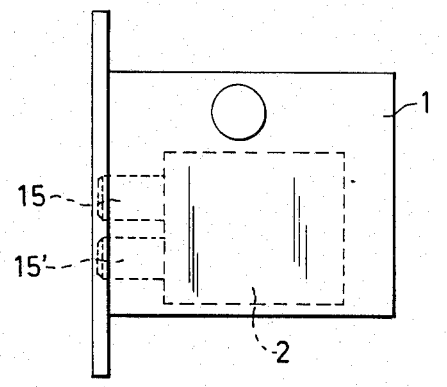
FIG. 5 is a view corresponding to FIG. 3, showing the device influenced manually only.

When the lock bolts 15, 15' are arranged located in extended positions as shown in FIG. 3, opening can also be performed by manual operation, from the inside by means of the handle 6 and from the outside by means of associated key 5. A rotary movement of the handle 6 is transferred by the axle 8 to the cog wheel 9, which is connected to the rack 10'. The abutment means 11 of said rack 10', which abuts the rear end portion of the groove 12, transfers the rotary movement of the handle 6 into a linear movement causing the complete lock unit 2 to move into a more adjacent position in relation to the internal bottom surface of the lock casing 1, and during said movement, the lock bolts 15, 15' are obviously also moved a corresponding distance, whereby the lock bolts disengage from an associated striking plate. The position taken up, with regard to the lock unit 2 and the lock bolts 15, 15' extending from same enclosed within the lock casing 1, is shown in FIG. 5, facilitating an opening movement to be performed. During the movement described above, the rack 10' connected to the cog wheel 9 moves the lock unit 2, whereas the second rack 10, connected to the cog wheel 7, can remain in the original position. However, if the last mentioned cog wheel 7 is rotated by means of a rotary movement transferred from the key 5, an opposite effect would be produced, i.e. the rack 10' and associated cog wheel 9 are not influenced by a displacement movement of the lock unit 2, since the abutment means 11 can move within the groove 12 during the movement of the lock unit 2.

The above described features makes it thus possible to perform a manual opening movement from one side of the lock device, even when the manually operable means at the opposed side has been jammed to prevent rotary movement. Such a feature can be of significant importance when, for example, evacuating an apartment building and the outside and manually operable member has been jammed to prevent rotary movement.

The above disclosed feature can also be obtained in other ways, for example by arranging the cog wheels 7, 9 freely rotatable in one rotary direction in relation to associated axles, but locked against rotation in the opposed rotary direction. Hereby can the cog wheels 7, 9 be arranged to mesh with a common rack 10, attached fixed in relation to the lock unit 2.

It is obviously also possible to use one cog wheel only, arranged connected to a cylinder lock mechanism 3 as well as the axle 8 to which the handle is attached. Such a design obviously results in a lower manufacturing cost, and is acceptable for many applications.

In order to reduce frictional contact existing between contacting surfaces of the lock unit 2 and the surrounding lock casing, balls or similar are advantageously located at desired locations between the lock unit 2 and the lock casing 1. Such balls could for example be located in shallow blind holes taken up in the outside surface of the lock unit 2 directed towards the lock casing 1, and existing friction between the units can hereby be reduced to a minimum.

The above described lock device is well suited to be used as a conventional entrance lock device, i.e. a lock device which during a certain time period of the day can be opened by means of an externally located electric switch. In such an application, the electrically operated striking plates used today are no longer required, and the functional security, as well as the security against damage caused by outside influence, will be considerably increased.

Furthermore, the shown and described embodiment is only intended to serve as an example of an embodiment within the scope of the inventive thought, and may thus be varied in a number of ways, while maintaining the important and characteristic features of the invention. The type of manually operable lock mechanism used can thus be varied further, as well as the design of included parts and their mechanical connection in relation to each other. Furthermore, cog wheel/-rack must not necessarily be used to accomplish manual opening movement, but also other technical solutions can be applied for transforming the manual movement into a linear movement for the lock unit 2.

The features which can be regarded as particularly characteristic for the inventive thought are thus, that an electrically operable lock unit 2 is located enclosed within an outer lock casing 1, that said lock unit takes up a first position in relation to said lock casing 1 in which associated lock bolt(s) 15, 15' can be brought into engagement with a striking plate or similar, and that an associated manually operable mechanism facilitates displacement of the lock unit 2 in relation to the lock casing 1 to positions in which the lock bolts 15, 15' no longer engages with associated striking plate or similar means, even though the lock bolts 15, 15' are maintained located in a position in relation to the lock unit 2 which normally constitutes the locking position. The direction of rotary movement of the motor M is indicated schematically in FIG. 2 by the doubled-headed arrow R.

The above disclosed features are a summary of the main and most important characteristic features on which the present invention is based.

Finally, it should also be mentioned, that the shape of the handle 6, as shown in FIG. 1, only is intended as a disclosure of a type which is more suitable for disabled persons that conventional handles, and thus intended to facilitate rapid and simple opening with a minimum of applied manual force. Also other and more conventional types of handles can obviously be used.

We claim:

1. A lock device comprising: a manually and electrically operable lock unit; an electrically powered means; said lock unit including at least one lock bolt which can be moved between two different positions of extension in relation to said lock unit by said electrically powered means;

a housing adapted to receive said lock unit;

a manually operable adjacent lock mechanism adapted to operate said lock unit;

said lock unit being movable between two different positions in relation to said housing when said manually operable adjacent lock mechanism is manually operated;

said at least one lock bolt being movable from a first position relative to said lock unit by said electrically powered means only when said electrically powered means is operating; said lock bolt being fixed against displacement relative to said lock unit when said electrically powered means is not operating;

said electrically operable lock unit including an electric motor having a rotary movement;

a first means for transforming said rotary movement into linear motion of said at least one lock bolt relative to said lock unit; said first means for transforming including a mechanical transmission gear adapted to move said at least one lock bolt from an initial position to another position.

2. A lock device according to claim 1, further comprising a key means for moving said lock unit relative to said housing;

said manually operable adjacent lock mechanism further comprising a cylinder lock mechanism operable by said key means;

a second means for transforming rotary movement of said key means into a linear movement of said lock unit relative to said housing between said first and said second positions;

said second means for transforming rotary movement including a wheel meshing with a rack, said rack extending longitudinally in a direction generally parallel to said linear motion of said at least one lock bolt.

3. A lock device according to claim 2, further comprising a handle means;

a third means for transforming rotary movement of said handle means into linear movement of said lock unit relative to said housing;

said lock unit being movable relative to said housing both by operation of said handle and by operation of said key means.

4. A lock device according to claim 3, wherein said third means for transferring rotary movement includes another wheel;

said rack being in independent engagement with both said wheel and said another wheel;

whereby said wheel and said another wheel each can independently drive said rack.

5. A lock device as claimed in claim 1, wherein said lock unit includes a lock unit body having a side wall;

said side wall having a groove therein having a longitudinal axis being generally parallel to said linear motion of said at least one lock bolt;

and further comprising a stop means co-acting with said groove; said stop means being fixed to said housing and extending into said groove;

in one of said two positions of said lock unit relative to said housing, and stop means being in connection with an end of said groove.

6. A lock device according to claim 5, wherein said stop means comprises a stop screw which is detachably attached to said housing; detachment of said stop means permitting disassembly of said electrically operable lock unit by means of a displacement movement in a direction away from said housing.

7. A lock device according to claim 1, wherein said electrically operable lock unit includes an external housing, said at least one lock bolt movably disposed in said housing; and an externally threaded axle extending in a direction of travel generally parallel to said linear motion of said at least one lock bolt; said axle being embraced by a nut connected to said at least one bolt by an attachment means extending from said nut; an electric motor being connected to said axle to cause a rotary movement for said axle in two alternative rotary directions; whereby movement of said nut occurs during rotation of said axle, thereby causing movement of said at least one lock bolt between the alternative positions of extension for said at least one lock bolt; in one of said alternative positions; said at least one lock bolt being substantially completely surrounded by said housing for said electrically operable lock unit.

* * * * *